United States Patent [19]

Shoji

[11] 4,059,971

[45] Nov. 29, 1977

[54] EARRING HAVING MAGNETICALLY SECURED DISPLACEABLE ORNAMENT FOR FACILITATING TELEPHONING

[76] Inventor: Ota Shoji, 207-9 Daibutsugahira, Nishiherano, Mikage-cho, Higashinada, Kobe, Japan

[21] Appl. No.: 730,316

[22] Filed: Oct. 7, 1976

[51] Int. Cl.[2] ..... A44C 7/00

[52] U.S. Cl. ..... 63/14 R; 63/29 M; 63/31

[58] Field of Search ..... 63/14 R, 14 A, 14 G, 63/31, 29 M

[56] References Cited

U.S. PATENT DOCUMENTS

| | | | |
|---|---|---|---|
| 2,682,759 | 7/1954 | Chalikian et al. | 63/14 C |
| 2,752,764 | 7/1956 | Lederer | 63/29 M |
| 3,613,393 | 10/1971 | Lamoureux | 63/14 D |

*Primary Examiner*—F. Barry Shay
*Attorney, Agent, or Firm*—McGlew and Tuttle

[57] ABSTRACT

An earring construction for use by a wearer which will facilitate phone calling without interference comprises an earring decorative body which has an exterior ornamental side which normally projects outwardly from the ear and an opposite earfacing side which contains a cavity having a magnet therein. An ear-engagement mounting includes a plate portion hinged to the ornament and which is attractable by the magnet in a closed position and which has an opposite earfacing side with means for engaging the earring on the ear. The hinged mounting of the ornament on the ear-engagement mounting permits the ornament to be swung outwardly to the side of the ear so that the ornament does not interfere with the placing of a telephone receiver earpiece close to the user's ear.

4 Claims, 4 Drawing Figures

EARRING HAVING MAGNETICALLY SECURED DISPLACEABLE ORNAMENT FOR FACILITATING TELEPHONING

BACKGROUND OF THE INVENTION

1. Field of the Invention

This invention relates, in general, to the construction of earrings and, in particular, to a new and useful earring which has a means for displacing an ornament to facilitate telephoning.

2. Description of the Prior Art

Many types and constructions of earrings are known. A disadvantage in the known types is that the ornamental portion of the earring projects outwardly from a side of the user's ear and interferes with the use of a telephone. With the known type earrings, the only way to eliminate such an inconvenience is to entirely remove the earring from the user's ear.

SUMMARY OF THE INVENTION

The present invention provides an earring which is constructed so that the ornamental body part of the earring may be swung outwardly to one side of the ear when the user of the earring wishes to telephone. This makes it possible to place the telephone receiver earpiece close to the user's ear without any interference. In accordance with a preferred construction of the invention, the ornamental body part includes a side facing the ear which has a cavity which contains a magnet. Hinged to the ornamental body, preferably adjacent a side thereof, is an engagement mounting which includes a plate which is attracted by the magnet to hold the mounting firmly against the ornament when the earring is being worn in the normal state. The mounting also includes means for fastening the earring to the person's ear. When the wearer desires to telephone, he merely moves the body away from the magnetic attraction to the plate so that it swings to one side of the person's ear and leaves a space adjacent the earlobe free for placing the receiver close to the earlobe.

Accordingly, it is an object of the invention to provide an improved earring which includes means for swinging an ornamental portion thereof out of position in which it blocks the ear so that the person may easily place a telephone receiver adjacent his ear.

A further object of the invention is to provide an earring which includes a body having a recessed cavity with first magnetic means for attracting and holding a plate member of a mounting which is hinged to the body in a manner such that the body may be swung outwardly from the plate member of the mounting, especially for facilitating telephoning by the wearer.

A further object of the invention is to provide an earring which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there is illustrated a preferred embodiment of the invention.

GENERAL DESCRIPTION OF THE PREFERRED EMBODIMENT

Figure 1:
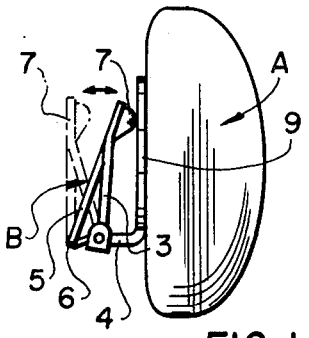
FIG. 1 is a side elevational view of an earring constructed in accordance with the invention.
Figure 2:
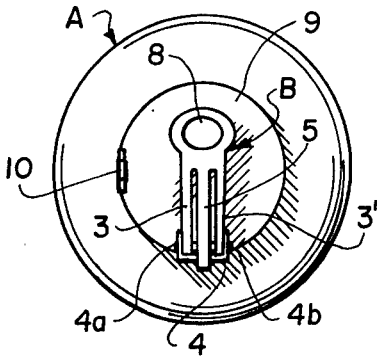
FIG. 2 is a rear elevational view of the earring shown in FIG. 1.
Figure 3:
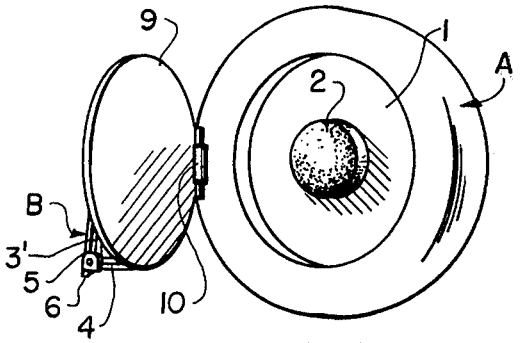
FIG. 3 is a perspective view indicating the earring in an open position for telephoning.

Referring to the drawings, in particular, the invention embodied therein comprises an earring which includes a main body or ornamental portion generally designated A which would normally project outwardly away from the wearer's ear.

In accordance with the invention, the main body portion A is provided with a cavity 1 on the side thereof which faces the wearer's ear which contains first magnetic means in the form of a magnet 2. Hinged to the body portion is an earring mounting portion generally designated B which, in the embodiment shown, is hinged on a hinge 10 located on one side of the body portion A. The ear-engagement mounting B includes a plate portion 9 containing a part of the hinge 10 which facilitates the inward and outward swinging of the body part A. The plate 9 contains second magnetic means in the form of a plate of metal which will be attracted to the magnet 2 and hold the body in a wearing position as indicated in FIG. 1.

In the embodiment shown, the ear-engagement mounting B includes a base or supporting seat 4 which extends outwardly from the lower part thereof and which includes two upstanding side portions **4*a* and 4*b* which are secured to outer side arm 3 and 3', respectively. The arms 3 and 3' are secured at their upper ends to a connecting piece 8 which also forms a support for an intermediate element 5 which extends obliquely and bears against the outer edge of the supporting seat 4**.

Figure 4:
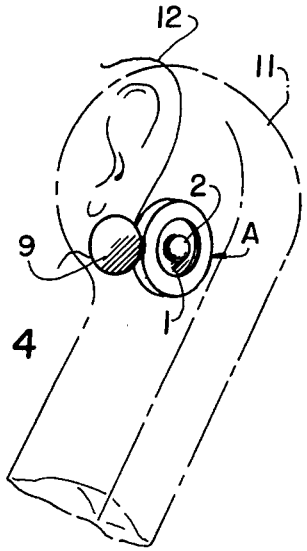
FIG. 4 is a schematic indication of the earring affixed to a person's ear showing the normal outline of a telephone receiver which may be placed over the device without interference.

As can be seen in FIG. 4, the ear-engagement mounting B may be affixed to the earlobe in the usual manner which, in this embodiment, is by clamping the central piece 5 to the earlobe. For this purpose, the central piece 5 and the connecting part 8 is made resilient and the inside face of the connecting part has a raised portion 7 which bears against the earlobe. Other fastening means, such as a means for mounting it on a pierced ear, may, of course, be provided. When the ear is positioned on the earlobe 12, and it becomes necessary to use the telephone, it is a simple matter to pivot the body A to an open position at which it rests alongside the earlobe at a location in which it does not interfere with the positioning of an earpiece 11 of a telephone receiver. After telephoning, it is merely necessary to pivot the body A on its hinge 10 backwardly a certain distance, and the magnet 8 will again hold the body against the plate 9.

While a specific embodiment of the invention has been shown and described in detail to illustrate the application of the principles of the invention, it will be understood that the invention may be embodied otherwise without departing from such principles.

What is claimed is:

1. An earring construction for use by a wearer and which will facilitate phone calling without interference, comprising an earring decorative body having an exterior ornamental side which is adapted to project outwardly from the person's ear and an opposite earfacing side, first magnet means mounted on said earfacing side, an ear-engagement mounting pivotally mounted on said body adjacent one side thereof and having at least a first side facing said body with at least a portion defining second magnet means attractable to said first magnet means to hold said body close against said ear-engagement mounting, said ear-engagement mounting including an opposite second side facing the wearer's ear, an ear-engagement device carried by said mounting on said opposite second side for holding the earring on a person's ear, said body being pivotal outwardly from said ear-engagement mounting to a position said body alongside the ear so as to free the ear of the wearer so that the earring will not interfere with the engagement of the ear by a telephone earpiece.

2. An earring according to claim 1, wherein said body has a recess upon the earfacing side, said first magnet means comprising a magnet disposed in said recess.

3. An earring construction according to claim 2, wherein said ear-engagement mounting includes a plate made of magnetically attractable material and comprises said second magnet means.

4. An earring construction according to claim 1, wherein said ear-engagement mounting comprises a plate, a hinge connected to a side of the plate and to a side of said body and pivotally mounting said body on said plate, said ear-engagement device projecting outwardly from the plate on the opposite side thereof from said body and including a supporting seat extending outwardly from the bottom of said plate and an upstanding central piece arm extending upwardly from said supporting seat and inwardly toward said plate and having a raised portion engageable with the ear.

* * * * *